US007217438B2

(12) United States Patent
Newsome et al.

(10) Patent No.: US 7,217,438 B2
(45) Date of Patent: May 15, 2007

(54) INKJET DEPOSITION APPARATUS AND METHOD WITH HORIZONTAL AND VERTICAL AXES DEVIATION CORRECTION

(75) Inventors: Christopher Newsome, Cambridge (GB); Takeo Kawase, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 83 days.

(21) Appl. No.: 10/475,293

(22) PCT Filed: Sep. 9, 2002

(86) PCT No.: PCT/GB02/04090

§ 371 (c)(1),
(2), (4) Date: Dec. 23, 2003

(87) PCT Pub. No.: WO03/022592

PCT Pub. Date: Mar. 20, 2003

(65) Prior Publication Data

US 2005/0248602 A1 Nov. 10, 2005

(30) Foreign Application Priority Data

Sep. 10, 2001 (GB) ..... 0121817.1

(51) Int. Cl.

| | |
|---|---|
| ***B05D 1/12*** | (2006.01) |
| ***B05D 5/06*** | (2006.01) |
| ***B41J 2/01*** | (2006.01) |
| ***B41J 29/393*** | (2006.01) |

(52) U.S. Cl. ..... 427/8; 427/66; 347/107; 347/19

(58) Field of Classification Search ..... 427/8, 427/66; 347/107, 19
See application file for complete search history.

(56) References Cited

U.S. PATENT DOCUMENTS

| | | | | |
|---|---|---|---|---|
| 5,250,956 | A * | 10/1993 | Haselby et al. | 347/19 |
| 5,374,993 | A | 12/1994 | Diehl et al. | |
| 5,600,350 | A | 2/1997 | Cobbs et al. | |
| 6,109,722 | A * | 8/2000 | Underwood et al. | 347/19 |
| 6,310,637 | B1 * | 10/2001 | Shimada et al. | 347/19 |
| 6,582,048 | B1 * | 6/2003 | Akahira et al. | 347/19 |
| 6,799,826 | B2 * | 10/2004 | Moon et al. | 347/19 |
| 6,890,050 | B2 * | 5/2005 | Ready et al. | 347/19 |
| 6,997,990 | B2 * | 2/2006 | Bae et al. | 118/325 |

FOREIGN PATENT DOCUMENTS

| | | |
|---|---|---|
| EP | 0 540 245 A2 | 5/1993 |
| EP | 0 589 718 A1 | 3/1994 |
| EP | 0 895 869 A2 | 2/1999 |
| EP | 0 934 831 A1 | 8/1999 |
| EP | 1 029 692 A1 | 8/2000 |
| FR | 2 642 702 | 8/1990 |

* cited by examiner

*Primary Examiner*—Stephen Meier
*Assistant Examiner*—Rene Garcia, Jr.
(74) *Attorney, Agent, or Firm*—Oliff & Berridge, PLC

(57) ABSTRACT

In an inkjet deposition apparatus, a print head is translated in a transverse direction relative to a substrate and the deviation of the print head relative to a first alignment mark is measured. The inkjet head is then translated in a longitudinal direction relative to the substrate and the deviation of the print head to a further alignment mark is measured. A correction factor for a control unit for translation stage of the apparatus is then generated from the measured deviations.

20 Claims, 5 Drawing Sheets

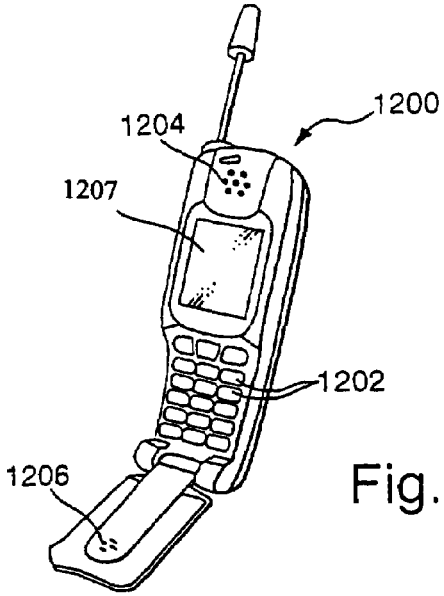
Fig.8.
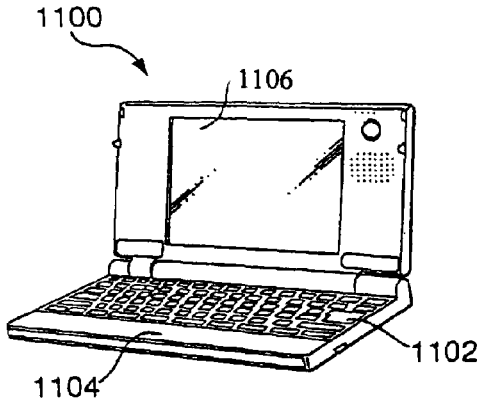
Fig. 7
Fig.9.
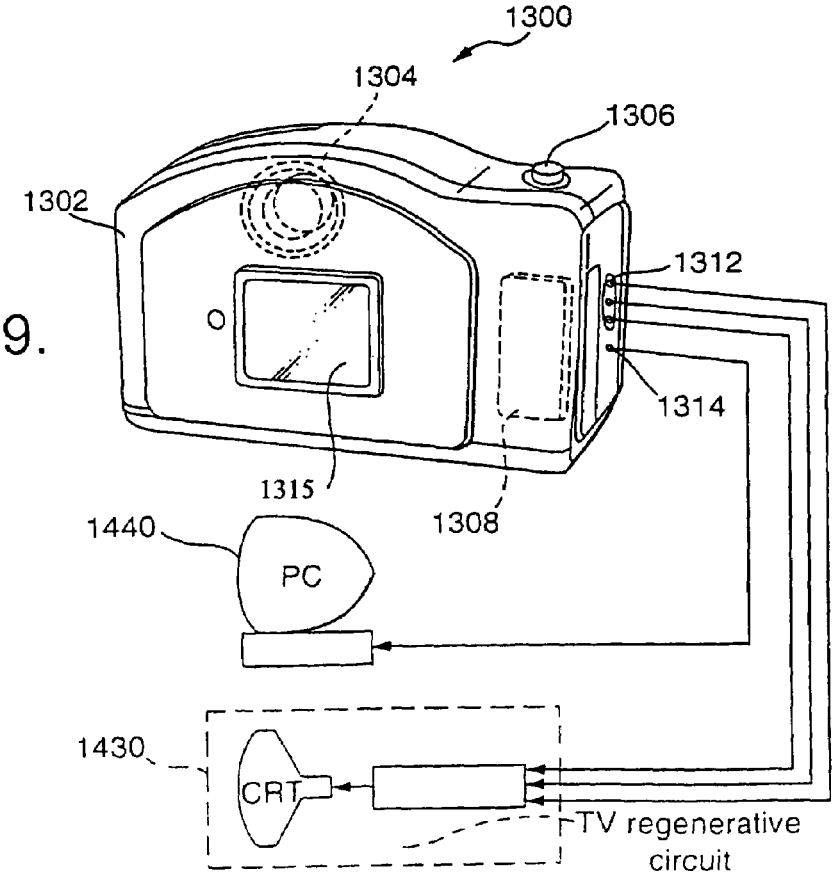

INKJET DEPOSITION APPARATUS AND METHOD WITH HORIZONTAL AND VERTICAL AXES DEVIATION CORRECTION

The present invention relates to the deposition of soluble materials and in particular to the deposition of soluble materials using inkjet technology.

BACKGROUND OF THE INVENTION

In recent years there has been an increase in the number of products which require, as part of their fabrication process, the deposition of organic or inorganic soluble or dispersible materials such as polymers, dyes, colloid materials and the like on solid surfaces. One example of these products is an organic polymer electroluminescent display device. An organic polymer electroluminescent display device requires the deposition of soluble polymers into predefined patterns on a solid substrate in order to provide the light emitting pixels of the display device. Further examples include the deposition of materials for forming organic polymer thin film transistors (TFTs) on a substrate and interconnects between chips assembled on the substrate using fluidic self assembly (FSA). The substrate may, for example, be formed of glass, plastics or silicon.

Typically, the substrate is a rigid substrate, thereby providing a rigid display device. However, products comprising flexible displays, which may be rolled or folded, are increasingly sought after, in particular where a large display is required. Such flexible displays provide substantially improved weight and handling characteristics and are less likely to fail due to shock during installation of the display device or use of the display device. In addition, relatively small display devices comprising a large display area may be conveniently provided.

In the manufacture of semiconductor display devices, including light emitting diode (LED) displays, it has been conventional to use photolithographic techniques. However, photolithographic techniques are relatively complex, time consuming and costly to implement. In addition, photolithographic techniques are not readily suitable for use in the fabrication of display devices incorporating soluble organic polymer materials. Concerns relating to the fabrication of the organic polymer pixels have, to some extent, hindered the development of products such as electroluminescent display devices incorporating such materials to act as the light emitting pixel elements.

In addition, the use of etch masks, such as photo masks for photolithography or metal shadow masks for patterning by evaporation deposition, is well known in conventional fabrication techniques. Hence, these processes will not be described in detail in the context of the present invention. However, such conventional fabrication techniques present severe process concerns for a number of devices including large scale display devices. Indeed, the etching and deposition of relatively long but extremely narrow lines has, for a long period of time, presented severe fabrication difficulties as it is very difficult to produce mechanically robust masks which will provide the required definition in the finished product. For example, a metal shadow mask for evaporation deposition for a large scale display device will inevitably exhibit some sagging or bowing in the central unsupported portion of the mask. This leads to an uneven distance between the mask and the substrate at the edge and the centre of the substrate respectively, thereby giving rise to uneven width and thickness of the deposited lines and adversely affecting the quality of the display.

Organic semiconducting polymers may be printed in high resolution patterns using inkjet technology and are therefore an attractive alternative to the more conventional semiconductor materials, such as silicon, for the production of light emitting diodes for flat display panels and field effect transistors.

Consequently, it has been proposed to use inkjet technology to deposit the soluble organic polymers in the fabrication of, for example, electroluminescent display devices and thin film transistors. Inkjet technology is, by definition, ideally suited to the deposition of such soluble or dispersible materials. It is a fast and inexpensive technique. In contrast to alternative techniques such as spin coating or vapour deposition, it instantly provides patterning without the need for an etch step in combination with a lithographic technique. Furthermore, the high specification processing techniques, such as vacuum and deposition processing, are not required, as is the case for the fabrication of inorganic semiconductors. The investment in capital equipment to fabricate devices can therefore also be reduced. Additionally, when compared to a spin coating technique there is less waste of the organic material as the material is deposited in very small quantities directly as the requisite predefined patterns.

However, the deposition of the soluble organic materials onto the solid surface using inkjet technology differs from the conventional use of the technology, to deposit ink on paper, and a number of difficulties are encountered. In particular, there is a primary requirement in a display device for uniformity of light output and uniformity of electrical characteristics. There are also spatial limitations imposed in device fabrication. As such, there is the non-trivial problem to provide very accurate deposition of the soluble polymers onto the substrate from the inkjet print head. This is particularly so for colour displays as respective polymers providing red, green and blue light emissions are required to be deposited at each pixel of the display.

Substrate sizes can be relatively large and are typically 40 cm×50 cm or larger. To assist the deposition of the soluble materials it has been proposed to provide the substrate with a layer which includes a pattern of wall structures defined in a de-wetting material so as to provide an array of wells or elongate trenches, bounded by the wall structures, for receiving the material to be deposited. Such a patterned substrate will be referred to hereinafter as a bank structure. When organic polymers in solution are deposited into the wells, the difference in the wettability of the organic polymer solutions and the bank structure material causes the solution to self align into the wells provided on the substrate surface.

However, it is still necessary to deposit the droplets of organic polymer material in substantial alignment with the wells in the bank structure. Even when such a bank structure is used, the deposited organic polymer solution adheres to some extent to the walls of the material defining the wells. This causes the central area of each deposited droplet to have, at best, a thin coating of deposited material, perhaps as low as 10% of the material in comparison to the material deposited at the walls of the bank structure. The deposited polymer material at the centre of the wells acts as the active light emissive material in the display device and if the polymer material is not deposited in accurate alignment with the wells, the amount and therefore the thickness of the active light emissive material can be further reduced. This thinning of the active light emissive material is of serious concern because the current passing through the material in use of the display is increased which reduces the life expectancy and the efficiency of the light emissive devices of the display. This thinning of the deposited polymer material will also vary from pixel to pixel if deposition alignment is not accurately controlled. This gives rise to a variation in the light emission performance of the organic polymer material from pixel to pixel because the LEDs constituted by the organic material are current driven devices and, as stated above, the current passing through the deposited polymer material will increase with any decrease in the thickness of the deposited material.

This performance variation from pixel to pixel gives rise to non-uniformity in the displayed image, which degrades the quality of the displayed image. This degradation of image quality is in addition to the reduction in operating efficiency and working life expectancy of the LEDs of the display. It can be seen therefore that accurate deposition of the polymer materials is essential to provide good image quality and a display device of acceptable efficiency and durability, irrespective of whether a bank structure is provided.

FIG. 1 shows a conventional inkjet deposition machine 100 which can be used for rigid or flexible substrates. The machine comprises a base 102 supporting a pair of upright columns 104. The columns 104 support a transverse beam 106 upon which is mounted a carrier 108 supporting an inkjet print head 110. The base 102 also supports a platen 112 upon which may be mounted a substrate 114, which is typically glass and has a maximum size of 40 cm×50 cm. The platen 112 is mounted from the base 102 via a computer controlled motorised support or translation stage 116 for effecting movement of the platen 112 both in a transverse and a longitudinal direction relative to the inkjet print head, as shown by the axes X and Y in FIG. 1. As the movement of the platen 112, and hence the substrate 114 relative to the inkjet head 110 is under computer control, arbitrary patterns may be printed onto the substrate by ejecting appropriate materials from the inkjet head 110 onto predetermined positions on the substrate. The computer control is further used to control the selection and driving of the nozzles and a camera may be used to view the substrate during printing. To enhance the accuracy of printing, position feedback may be provided for the translation stage, thereby allowing the position of the platen to be continually monitored during motion. In addition, a signal used for communicating between the translation stage and computer control can be used as a clock for timing inkjet ejection.

Two distinct techniques can be implemented to synchronise the position of the droplets to the substrate. One technique is the use of a signal as a trigger source for the timing of the ejection according to the velocity of the substrate. By matching the frequency of the ejection from the head to this velocity, a certain deposition spacing of droplets can be achieved. By changing the ratio of the two, the spacing between deposited droplets can be varied. Alternatively, another technique involves the use of the signal used in a position encoder system implemented in the translation stage. The position encoder is used in the translation stage to accurately determine the position of the moving platen. The position encoder sends a signal to the controller as a series of electrical pulses, the position and velocity of the stage is determined from this signal. This signal can therefore also be implemented as the timing signals for the inkjet head.

In either of the above cases, there is a requirement that the position of the head to the substrate is accurate to within microns to obtain uniform patterning of the material on to the substrate with the desired accuracy. To achieve this, accurate control of the positioning of the stage is crucial.

However, positional errors arising from mechanical limitations of the translation stage can occur, which can limit the positional accuracy of the inkjet print head 110 relative to the platen 112 and therefore the substrate 114 on which the high resolution patterning is required. Such limitation in positional accuracy may arise from the following exemplary causes.

The translation of the stage, and hence the platen, along its path may be erroneous, i.e. the distance actually translated by the stage may be marginally longer or shorter than the required distance which has been programmed into the machine. This can be explained with reference to FIG. 2, where the intended translation space is shown by the solid line rectangle defined by the points A, B, C, D, i.e. the actual points on the substrate which must be reached by the inkjet head; and the actual translation space, which is shown by the dotted line parallelogram defined by the points A, B', C', D' and resulting from errors in the translation length and construction angle θ between the x and y axes of the translation system.

These errors in the translation length may occur in one or both of the axes shown in FIG. 2 and it can be seen from FIG. 2 that instead of the translation length from the point A (origin point) being either x or y, for example, the actual translation may be $x+\Delta x$ or $y+\Delta y$. Errors may also be anticipated resulting from the combination of the two axes in an x-y configuration, where there may be an error in the construction angle subtended by the two axes. For printing of an accurate pattern, the angle subtended by the two axes should be exactly 90° but frequently this is not the case due to the manufacturing tolerances of the inkjet machine. If the subtended angle is not exactly 90°, it is to be expected that the position of the stage away from the origin point A will be in error and, at substantially large displacements from the point A, the erroneous positioning of the stage would be likely to cause unacceptable offsets in the deposited droplets from the inkjet head.

It will be appreciated that preparation alignment of the translation stage relative to the print head is required prior to actual deposition of droplets from the inkjet head to ensure that the translation stage and the head are aligned in both the x and y directions throughout the intended translation space, as defined by the points A, B, C and D in FIG. 2.

SUMMARY OF THE INVENTION

Accordingly, it is an object of the present invention to provide a method by which such positional errors incurred by the mechanical limitations of the translation stage may be compensated.

It is also an object of the present invention to provide an inkjet patterning apparatus which provides such compensation.

According to a first aspect of the present invention, there is provided a method of correcting positional errors between a platen of a translation stage for supporting a substrate for printing and an inkjet print head, comprising positioning the print head in a first position in alignment with a first alignment mark, translating the print head relative to the platen in a transverse direction x of the substrate from the first position to a second position, measuring the deviation between the second position and a second alignment mark at a first predetermined distance from the first position in the transverse direction, translating the print head relative to the platen in a longitudinal direction y of the platen from the first position to a third position, measuring the deviation between the third position and a third alignment mark provided at a second predetermined distance from the first position in the longitudinal direction, and generating a correction factor from the lateral and/or longitudinal deviations for use in controlling movement of the translation stage.

Preferably, a first correction factor is generated for use in the transverse direction x and a second correction factor is generated for use in the longitudinal direction y.

Advantageously, an offset angle θ subtended between the axes x and y is determined from the measured deviation of one of the axes and the correction factor for use in controlling movement of the translation stage in the other of the axes is compensated in dependence upon the determined offset angle θ.

In a second aspect of the present invention there is provided an inkjet deposition apparatus comprising an inkjet print head, a platen for supporting a substrate on which a pattern is to be printed by ejection of a material as a series of droplets from the inkjet head, and a translation stage for providing relative movement between the print head and the platen along a transverse axis x and a longitudinal axis y and control means for controlling the relative positioning of the print head and platen along the x and y axes, wherein the control means is arranged to apply a correction factor for correcting positional errors between the platen and the print head along the x axis and/or along the y axis.

In a third aspect of the present invention there is provided an electronic, opto-electronic, optical or sensor device fabricated in accordance with the method of the first aspect or by an inkjet deposition apparatus according to the second aspect.

Embodiments of the present invention will now be described, by way of further example only, with reference to the accompanying drawings, in which:

BRIEF DESCRIPTION OF THE SEVERAL VIEWS OF THE DRAWINGS

FIG. 7 is a schematic view of a mobile personal computer incorporating a display device fabricated in accordance with the present invention;

FIG. 8 is a schematic view of a mobile telephone incorporating a display device fabricated in accordance with the present invention; and FIG. 9 is a schematic view of a digital camera incorporating a display device fabricated in accordance with the present invention.

DETAILED DESCRIPTION OF THE INVENTION

Figure 1:
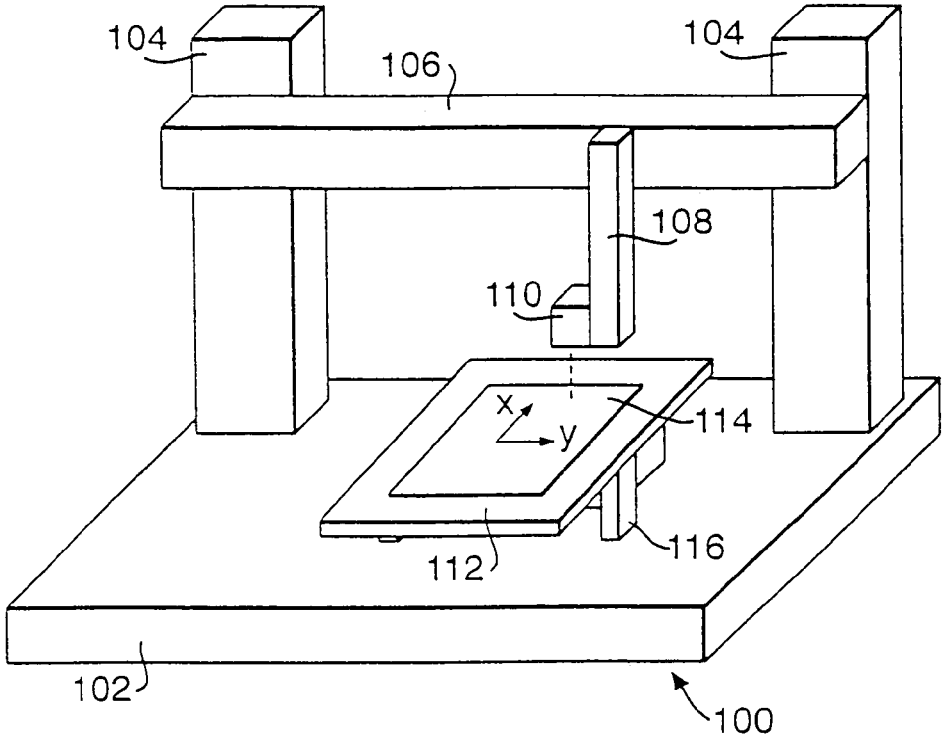
FIG. 1 is a schematic representation of an inkjet deposition apparatus.
Figure 2:
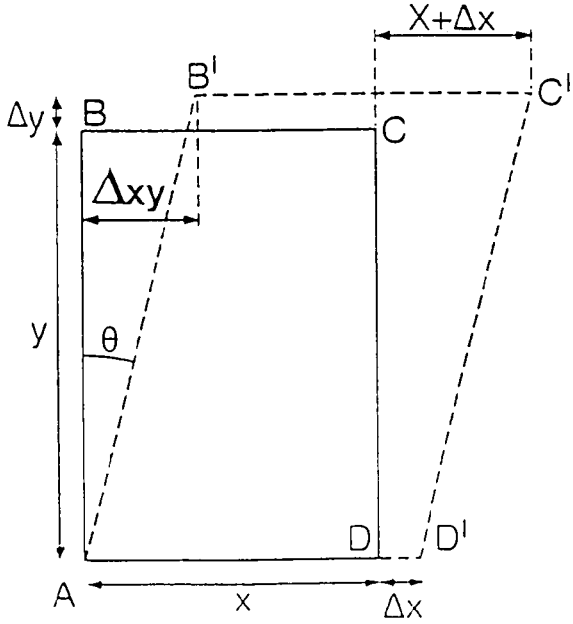
FIG. 2 is a schematic diagram illustrating the positional errors which may occur in the inkjet deposition apparatus shown in FIG. 1.
Figure 3A:
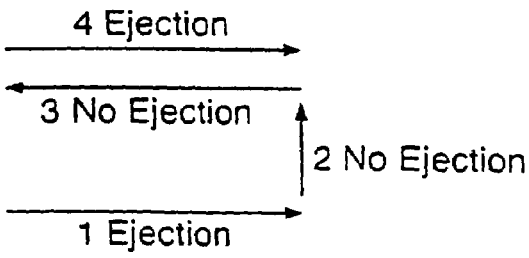
FIGS. 3*a* and 3*b* show, diagrammatically, examples of printing modes of the inkjet deposition apparatus shown in FIG. 1.
Figure 3B:
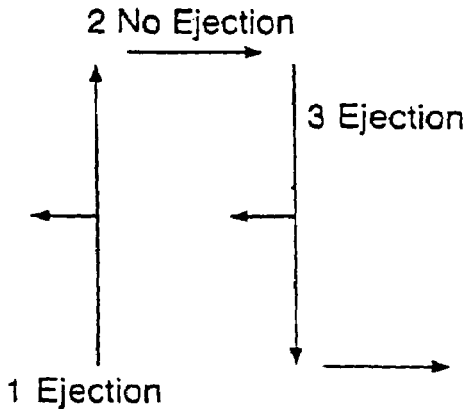

In an inkjet printing process, there are two principle methods which are generally employed to provide relative movement between a translation stage carrying a platen for supporting a substrate and an inkjet print head, and these are shown in FIGS. 3*a* and 3*b*. In the method shown in FIG. 3*a*, translation occurs along the x axis and printing occurs when translation is made from left to right, as shown in the figure. This is known as the positive x direction and printing along the x axis is therefore made in a unidirectional mode. At the end of the first line of printing, shown as line 1 in FIG. 1, ejection is terminated and the platen is moved by the translation stage in the y axis direction, shown as line 2 in FIG. 1, to a position where the next line of droplets for printing are to be ejected by the inkjet head. The platen is then moved by the translation stage in the opposite direction to that during which printing has occurred, i.e. from right to left, shown as line 3 in FIG. 3*a*. This is known as the negative x direction. The platen is then moved again in the positive x direction, without any further displacement along the y axis, to print the second line of the required pattern, shown as line 4 in FIG. 3*a*. This movement by the translation stage is repeated until the required pattern is complete, i.e. the relative position of the print head has moved from point A to point C, as shown in FIG. 2.

The second principle method of inkjet printing is to print with movement of the translation stage in the y axis direction, as shown in FIG. 3*b*. From an origin point (such as point A shown in FIG. 2), the translation stage is moved along the y axis and ejection of the material to be printed occurs from the print head. This is shown as line 1 in FIG. 3*b*. Ejection from the print head is terminated and the translation stage is then moved in the x axis direction, shown as line 2 in FIG. 3*b*. The translation stage is then moved in the opposite direction along the y axis and printing occurs. This process is repeated until the required patterned image is complete. Hence, in this second printing mode, printing occurs in both translation directions along the y axis.

However, in reality, positional errors are incurred due to the mechanical limitations of the translation stage such that actual translation along the x axis is, dependent upon whether the translation length is longer or shorter than the target length, $x+\Delta x$ or $x-\Delta x$, and not x; and actual translation along the y axis is $y+\Delta y$ or $y-\Delta y$, and not y. Furthermore, the angle subtended between the two axes x and y should be 90°, i.e. the two axes should be orthogonal to one another but, invariably, an offset θ is found in this subtended angle. Hence, when printing occurs along line 1 shown in FIG. 3*a*, printing occurs along the line A D' shown in FIG. 2, and not along the required line A D. Usually, the offset or error Δx is found to be relatively constant for all co-ordinates along the longitudinal axis y because the offset is caused by mechanical limitations in the translation stage.

However, the offset angle θ gives rise to positional errors which increase with displacement along the y axis, such that even if the error Δx was not present in the translation stage along the axis x, an offset Δxy would be created along the x axis when printing the final line of the required pattern, as shown in FIG. 2. In practice, some error Δx is invariably found to be present such that the final point of the pattern to be printed, namely point C', is offset from the desired position C by $\Delta xy+\Delta x$ in the x axis direction and Δy in the y axis direction.

Since the actual translation length may be longer or shorter than the target length, the actual printing will, correspondingly, be longer or shorter than intended.

Such positional errors are not problematical in the usual application for inkjet deposition machines, such as printing images on paper, but for patterning of electronic devices such positional errors can be very problematical.

Figure 4:
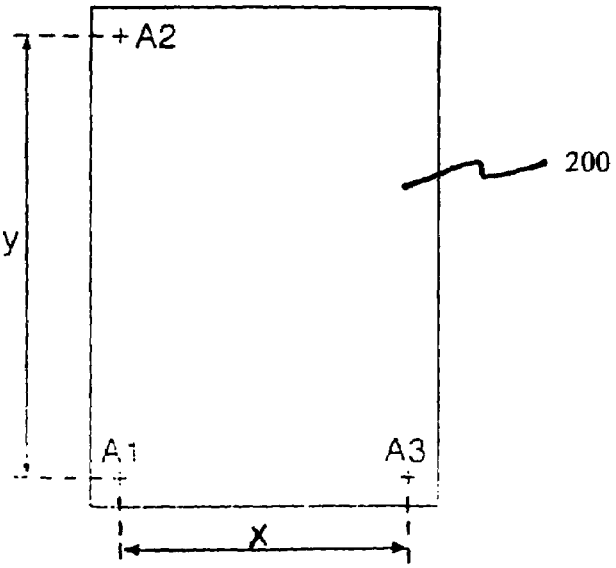
FIG. 4 is a schematic plan view of a substrate carrying alignment marks for use with the inkjet deposition apparatus shown in FIG. 1.

With the present invention, the error which occurs in the translation along the x axis is compensated by the use of a correction factor (or scaling factor) which is determined by the use of alignment marks on the receiving substrate. Such a substrate is shown in FIG. 4 where it can be seen that a substrate 200 carries alignment marks A1, A2 and A3. In essence, in the embodiment shown, the positions of alignment marks A1, A2 and A3 correspond respectively to the points A, B and D in the intended translation space shown in FIG. 2.

To determine the correction factor, the alignment marks are viewed in situ with a suitable device, such as a CCD microscope.

Firstly, the print head is aligned with the alignment mark A1 on the substrate which, in essence, is the origin, i.e. co-ordinates (0, 0), of the intended translation space. Initially, it is necessary to select and orientate one of the axes of the translation stage, either the x axis or the y axis, so that, if there is relative movement between the translation stage and the inkjet head along the selected axis, the droplets ejected from the inkjet head will actually be deposited along the selected axis. Usually, the x-axis is selected for this purpose. Assuming that the x-axis is selected, this alignment along the x-axis is achieved by rotating the translation stage relative to the print head whilst the print head is aligned with the origin. The translation stage is then moved and droplets is deposited along the intended x-axis. If there is any angular misalignment of the x-axis, the deposited droplets will be offset from the x-axis. This is irrespective of the actual translation length along the x-axis. The print head is then re-aligned with the origin and the translation stage is rotated relative to the print head. A further series of droplets are deposited along the intended x-axis and checked for any offset from the desired x-axis. This process is repeated until there is alignment of the x-axis with the deposited droplets. Hence, one boundary of the intended translation space is aligned with one axis of the translation stage and thus it is assured that the line AD of the intended translation space is aligned with the x-axis of the translation stage. This process has been described with reference to actual droplet deposition. However, the alignment of the translation space boundary can be carried out without droplet deposition by viewing the print head between each iterative rotation of the translation stage.

The distance x of the point D from point A in the intended translation space is known and the alignment mark A3 is located so that it is spaced at the distance x from alignment mark A1 i.e. in correspondence with point D. The translation mechanism is then operated, which is typically under computer control, through a commanded distance x along the positive x axis, i.e. to co-ordinates (x, 0) and the correlation of the inkjet head with the alignment mark A3 is checked. If the positional error Δx is present, this can be seen and measured. The print head is then returned to co-ordinates (0, 0) in correlation with alignment mark A1. The translation stage is then moved in the direction of the y axis by the distance y and the correlation of the inkjet head with the alignment mark A2 is checked. If the positional error Δy only is present, the print head will be aligned along the y axis but displaced from the alignment mark A2 by a distance Δy. In this case, only compensation in the y axis direction is required. However, if the offset angle θ is also present, which is usually the case, the print head will not be aligned along the y axis but will be displaced also in the x axis direction. This displacement in the x axis direction may be in either the positive or negative x axis direction. If an offset angle θ is present, such as the positive x axis direction shown in FIG. 2, compensation in both the x and y axis directions will be required when translating the translation stage in the y axis direction to compensate for the positional errors caused by the offset in the angle subtended by the two axes.

A calculation of the correction factors required to move along the intended translation space will now be explained.

Assuming Δx is the error in positional translation when moving along the positive x-axis direction only. Δy is the error in positional translation when moving along the positive y-axis direction only.

X Direction Correction

For Positive Δx & Δy from Origin A.

When y=0, the x direction scaling correction factor is $$x/(x+\Delta x) \tag{1}$$

Therefore the actual position to move to is $$axx/(x+\Delta x) \tag{2}$$

where a is the intended x coordinate.

When y>0 the angle subtended between the two axes θ, must be accounted for.

Using geometric principles, it can be seen that $$\tan\theta=\Delta xy/(y+\Delta y) \tag{3}$$

Therefore Δxy' (an error in the x direction at any point along the y axis) is dependent upon the length travelled along the y axis, b. From geometry $$\Delta xy'=bx\tan\theta \tag{4}$$

Therefore , the actual position to which the translation stage should be moved, accounting for these positional errors, is given by subtracting expression (4) from expression (2); namely $$axx/(x+\Delta x)-bx\Delta xy/(y+\Delta y) \tag{5}$$

since Δxy' is in the positive x direction. For Δxy' in the negative direction, then the correction will be expression (2)+(4).

Y Direction Correction

For Positive Δy from Origin A.

The correction for the y direction follows a scaling factor according to the distance moved along the y axis, namely a displacement b, is as follows:

$$y/(y+\Delta y) \tag{6}$$

Therefore the actual coordinate to move to is $$bxy/(y+\Delta y) \tag{7}$$

By the above process, the alignment of the print head relative to the points A, B, C, D of the intended translation space can be found and appropriate positional compensation, in the form of a correction factor, which can compensate for any of Δx, Δy and θ, in any combination, can be incorporated into the control program for the translation stage. The translation stage is usually controlled by the use of a computer code and the inclusion of the necessary corrections for the stage can be incorporated into such a code.

For the print mode shown in FIG. 3*a*, the correction factor would ensure that, for any line to be printed, the position of a target print deposition site at the end of the x axis is correct, i.e. the site is at point D and not point D'. To return to the beginning of any subsequent line to be printed, the knowledge of the offset angle as determined by the measurements determined through use of the alignment marks is used. Hence, at any line at any point along the y axis, the compensating shift along the x axis direction always ensures that the start and end of any printed line occurs in alignment with lines AB and CD respectively and not along lines AB' and C'D'. Printing can therefore occur in the intended translation space defined by the points A, B, C, D and not the erroneous translation space defined by the points A B' C' D'.

If bi-directional printing is adopted for this mode of x axis printing (i.e. printing also along line 3 shown in FIG. 3*a*), similar compensation can be implemented. For the printing mode shown in FIG. 3*b*, i.e. printing with translation in the y axis direction, a different correction factor is required for the control program of the translation stage. The correction factor must compensate for the errors $\Delta x$, $\Delta y$ and the offset angle $\theta$ during any line being printed. If a correction is not made in both the x and y axes directions, the pattern will be printed along a line set at the offset angle $\theta$. For example, if starting printing at point A and the target for the end of the print line is point B, then the actual position reached will be point B'. Therefore to correct for the offset angle in this print mode, the x axis must also be translated by a predetermined displacement and velocity of the translation stage, such that the correction applied is correct throughout the translation of the y axis. The displacement and velocity of the translation stage along the x axis is selected to be directly proportional to, respectively, the displacement and velocity of the translation stage only along the y axis. In this manner the pattern will be printed along all lines in the y axis direction between the lines AB and DC and not along the lines AB' and D'C', and intervening lines.

Figure 5:
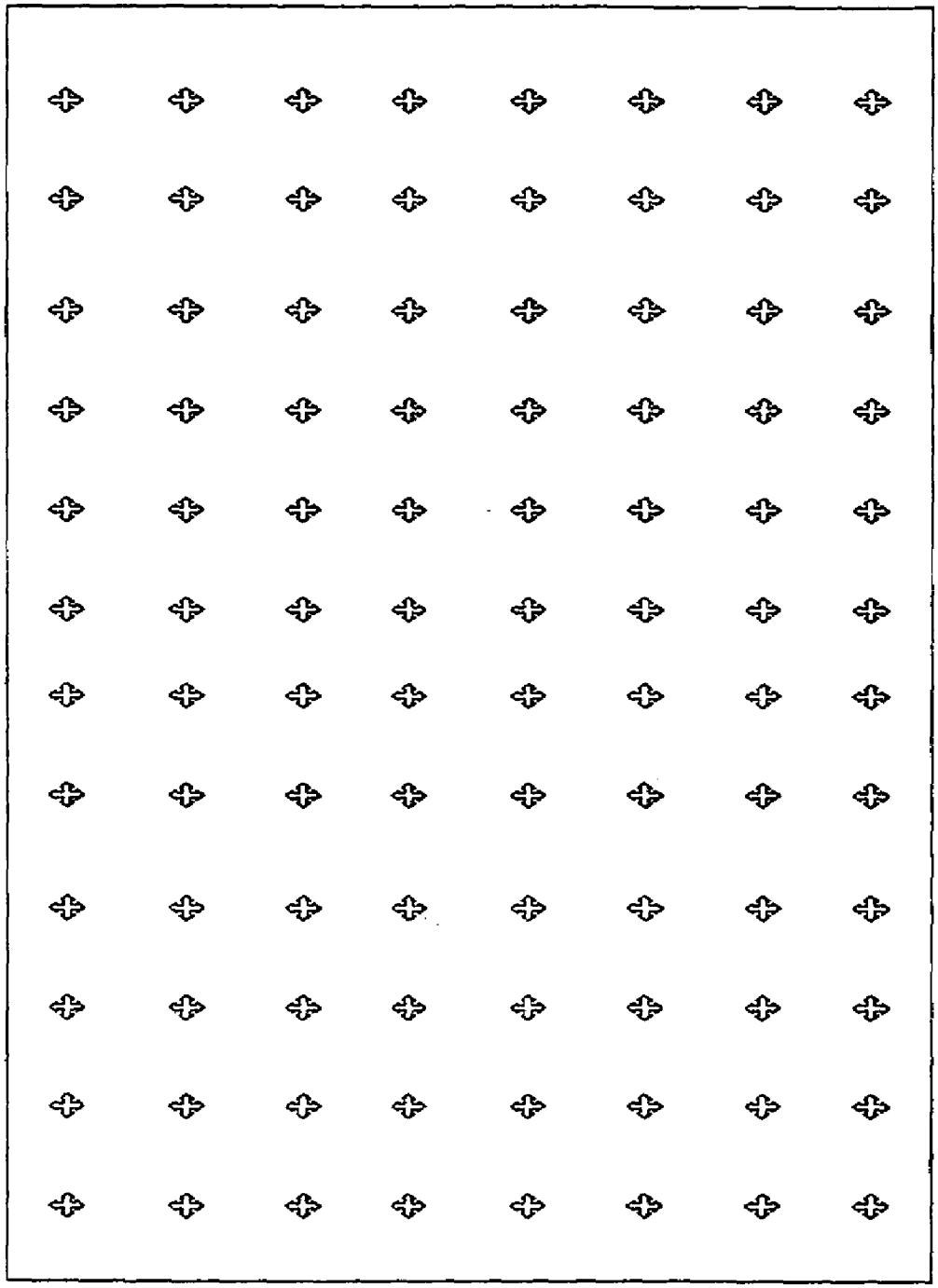
FIG. 5 is a schematic plan view of a substrate carrying alignment marks for use with the present invention.

As described above, there is an increasing need to print devices onto relatively large area plastics substrates. These substrates may be supported on a platen during the print process but it has been found that the substrate itself may include inherent distortions, such as surface discontinuities, and furthermore, the substrate itself may distort due to changes in the ambient conditions during the fabrication process. These distortions may cause the substrate to twist slightly from one end to the other, or minute rippling of the substrate on the platen can occur. Hence, the correction factor determined for one part or area of the substrate may not be suitable for use in another area of the substrate. Therefore, a plurality of the sets of alignment marks can be provided on the substrate and the method of the present invention can be repeated for some or all of the sets and a number of correction factors can therefore be derived and applied selectively at the various areas of the substrate. FIG. 5 shows an example of such a substrate where it can be seen that the alignment marks are distributed over the whole deposition area of the substrate and not just at the comer locations, as with the substrate shown in FIG. 4.

The equations (1)–(7) give a linear approximation derived from the positional information of three alignment marks located at the corner locations. The linear approximation can be applied to calculate target positions (the positions where droplets should be deposited) from the distributed alignment marks. The substrate is divided into plural segments, in which each segment contains at least three alignment marks, and the linear approximation can be carried out within each segment to obtain respective sets of the correction factors. In this case, the correction factors of one segment can be different from those of one or more of the other segments due to the distortion of a substrate. The linear approximation is especially suitable to the case when a single substrate involves many independent devices. The alignment marks can be located at the boundary regions between the independent devices. The motion of an inkjet head or substrate is controlled so as to trace zigzag lines derived from the different correction factors.

The linear approximation is the simplest method to correct the positional errors, and a better correction can be achieved with higher order polynomial approximation or spline curve approximation. The positions of the distributed alignment marks are fitted with polynomials or spline curves, and the target position is calculated from the polynomial or spline curve. The motion of an inkjet head or substrate is controlled so as to trace the polynomial curve or the spline curve. Polynomial and spline curve approximations are well known numerical analysis techniques and will not therefore be described further in the context of the present invention.

A better correction can be obtained also by interpolating the correction factors. The segment used in the linear approximation is divided into sub-segments which have a different set of the correction factors obtained by interpolation.

Inkjet deposition machines deposit droplets by feeding drive signals, typically supplied from a waveform generator, to the inkjet print head. The provision of the drive signals to the inkjet head may be timed by clock pulses to ensure that the droplets are ejected at the correct timings and therefore are positioned at the required location on the substrate. The spacing between each droplet in a printed line is determined by the timing of the pulses and the velocity of the translation stage. For printing of devices, the absolute position of printing must be maintained throughout the whole area of printing. Hence, if the translation length of the translation stage is shorter or longer than the target length, the lines actually printed will be correspondingly longer or shorter than intended. Actual printing is controlled by clock pulses, as described above, and if the translation length is corrected, but the frequency of the clock pulses for printing is not corrected, then the printed pattern may be truncated prematurely and the intended fully printed pattern may not be achieved. This will result in an offset in the printed pattern which can be critical in the printing of devices.

The correction factor or factors developed as described above can, therefore, also be used advantageously to correct the frequency of the clock pulses required for printing. This can be achieved by 'scaling' the clock frequency for patterning by the same scaling factor used to correct the translation length of the translation stage. Thus, the data used to control printing will correlate to that required for the intended target pattern. This scaling of the clock frequency can be used most advantageously in an inkjet deposition apparatus which monitors the position of the translation stage and controls the timing of the clock pulses in dependence upon the monitored position, such as described in GB application No. 0121814.8.

Figure 6:
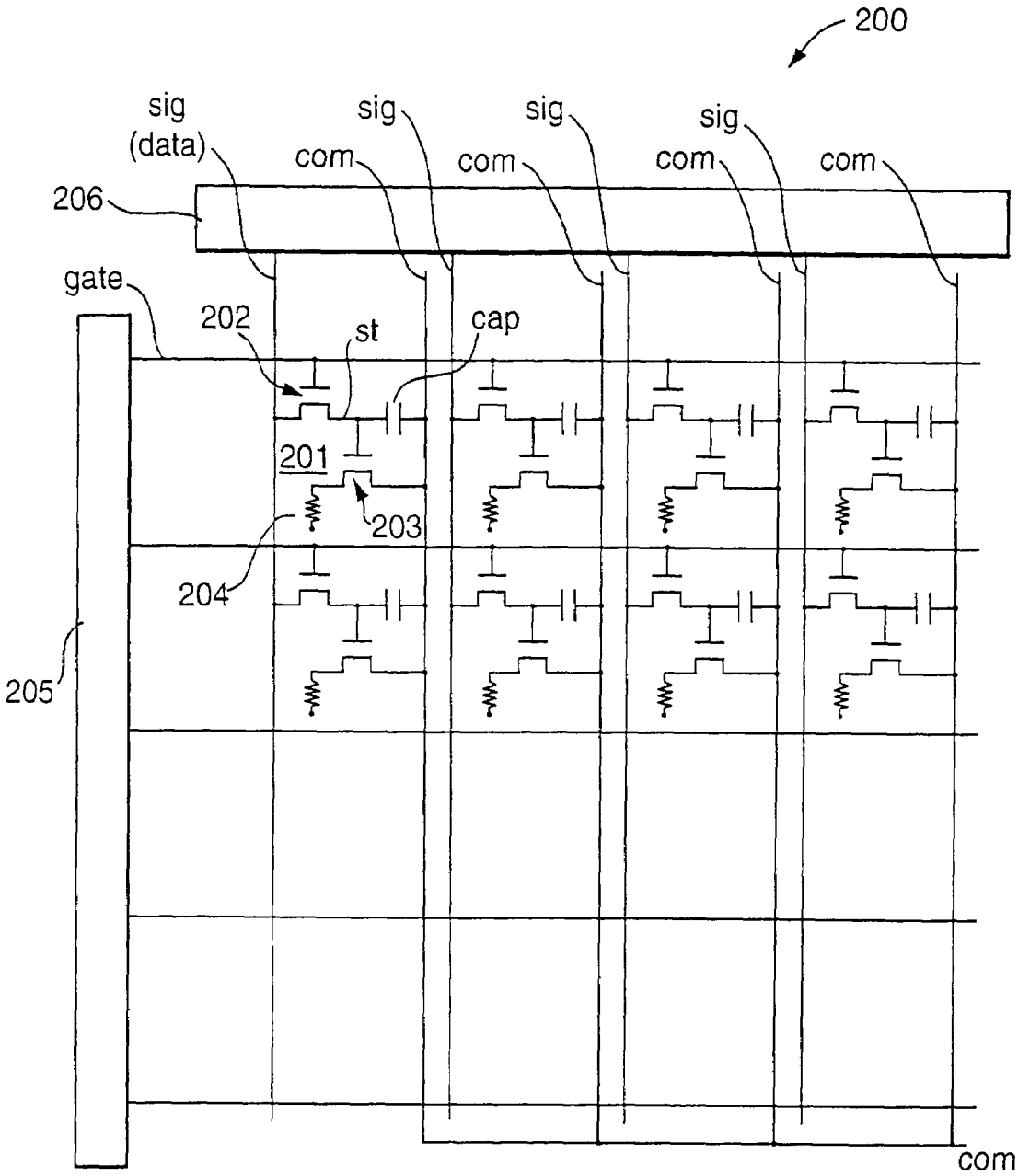
FIG. 6 shows a block diagram of an electro-optic device.

FIG. 6 is a block diagram illustrating an active matrix type display device (or apparatus) incorporating electro-optical elements, such as organic electroluminescent elements as a preferred example of the electro-optical devices, and an addressing scheme which may be fabricated using the method or apparatus of the present invention. In the display device 200 shown in this figure, a plurality of scanning lines "gate", a plurality of data lines "sig" extending in a direction that intersects the direction in which the scanning lines "gate" extend, a plurality of common power supply lines "com" extending substantially parallel to the data lines "sig", and a plurality of pixels 201 located at the intersections of the data lines "sig" and the scanning lines "gate" which are formed above a substrate.

Each pixel 201 comprises a first TFT 202, to which a scanning signal is supplied to the gate electrode through the scanning gate, a holding capacitor "cap" which holds an image signal supplied from the data line "sig" via the first TFT 202, a second TFT 203 in which the image signal held by the holding capacitor "cap" is supplied to the gate electrode (a second gate electrode), and an electro-optical element 204 such as an electroluminescent element (indicated as a resistance) into which the driving current flows from the common power supply line "com" when the element 204 is electrically connected to the common power supply line "com" through the second TFT 203. The scanning lines "gate" are connected to a first driver circuit 205 and the data lines "sig" are connected to a second driver circuit 206. At least one of the first circuit 205 and the second circuit 205 can be preferably formed above the substrate above which the first TFTs 202 and the second TFTs 203 are formed. The TFT array(s) manufactured by the methods according to the present invention can be preferably applied to at least one of an array of the first TFTs 202 and the second TFTs 203, the first driver circuit 205, and the second driver circuit 206.

The present invention may therefore be used to fabricate displays and other devices which are to be incorporated in many types of equipment such as mobile displays e.g. mobile phones, laptop personal computers, DVD players, cameras, field equipment; portable displays such as desktop computers, CCTV or photo albums; instrument panels such as vehicle or aircraft instrument panels; or industrial displays such as control room equipment displays. In other words, an electro-optical device or display to which the TFT array(s) manufactured by the methods according to the present invention is (are) applied as noted above can be incorporated in the many types of equipment, as exemplified above.

Various electronic apparatuses using electro-optical display devices fabricated in accordance with the present invention will now be described.

<1: Mobile Computer>

An example in which the display device fabricated in accordance with one of the above embodiments is applied to a mobile personal computer will now be described.

FIG. 7 is an isometric view illustrating the configuration of this personal computer. In the drawing, the personal computer 1100 is provided with a body 1104 including a keyboard 1102 and a display unit 1106. The display unit 1106 is implemented using a display panel fabricated according to the patterning method of the present invention, as described above.

<2: Portable Phone>

Next, an example in which the display device is applied to a display section of a portable phone will be described. FIG. 8 is an isometric view illustrating the configuration of the portable phone. In the drawing, the portable phone 1200 is provided with a plurality of operation keys 1202, an earpiece 1204, a mouthpiece 1206, and a display panel 12O7. This display panel 1207 is implemented using a display device fabricated in accordance with the method of the present invention, as described above.

<3: Digital Still Camera>

Next, a digital still camera using an OEL display device as a finder will be described. FIG. 9 is an isometric view illustrating the configuration of the digital still camera and the connection to external devices in brief.

Typical cameras use sensitized films having light sensitive coatings and record optical images of objects by causing a chemical change in the light sensitive coatings, whereas the digital still 1300 generates imaging signals from the optical image of an object by photoelectric conversion using, for example, a charge coupled device (CCD). The digital still camera 1300 is provided with an OEL element 1315 at the back face of a case 1302 to perform display based on the imaging signals from the CCD. Thus, the display panel 1315 functions as a finder for displaying the object. A photo acceptance unit 1304 including optical lenses and the CCD is provided at the front side (behind in the drawing) of the case 1302.

When a cameraman determines the object image displayed in the OEL element panel 1315 and releases the shutter, the image signals from the CCD are transmitted and stored to memories in a circuit board 1308. In the digital still camera 1300, video signal output terminals 1312 and input/output terminals 1314 for data communication are provided on a side of the case 1302. As shown in the drawing, a television monitor 1430 and a personal computer 1440 are connected to the video signal terminals 1312 and the input/output terminals 1314, respectively, if necessary. The imaging signals stored in the memories of the circuit board 1308 are output to the television monitor 1430 and the personal computer 1440, by a given operation.

Examples of electronic apparatuses, other than the personal computer shown in FIG. 7, the portable phone shown in FIG. 8, and the digital still camera shown in FIG. 9, include OEL element television sets, view-finder-type and monitoring-type video tape recorders, vehicle navigation and instrumentation systems, pagers, electronic notebooks, portable calculators, word processors, workstations, TV telephones, point-of-sales system (POS) terminals, and devices provided with touch panels. Of course, OEL devices fabricated using the method of the present invention can be applied not only to display sections of these electronic apparatuses but also to any other form of apparatus which incorporates a display section.

Furthermore, the display devices fabricated in accordance with the present invention are also suitable for a screen-type large area television which is very thin, flexible and light in weight. It is possible therefore to paste or hang such large area television on a wall. The flexible television can, if required, be conveniently rolled up when it is not used.

Printed circuit boards may also be fabricated using the technique of the present invention. Conventional printed circuit boards are fabricated by photolithographic and etching techniques, which increase the manufacturing cost, even though they are a more cost-oriented device than other microelectronics devices, such as IC chips or passive devices. High-resolution patterning is also required to achieve high-density packaging. High-resolution interconnections on a board can be easily and reliably be achieved using the present invention.

Colour filters for colour display applications may also be provided using the present invention. Droplets of liquid containing dye or pigment are deposited accurately onto selected regions of a substrate. A matrix format is frequently used with the droplets in extremely close proximity to each other. In situ viewing can therefore prove to be extremely advantageous. After drying, the dye or pigments in the droplets act as filter layers.

DNA sensor array chips may also be provided using the present invention. Solutions containing different DNAs are deposited onto an array of receiving sites separated by small gaps as provided by the chips.

The aforegoing description has been given by way of example only and it will be appreciated by a person skilled in the art that modifications can be made without departing from the scope of the present invention. For example, the invention has been described with reference to movement of the platen relative to the print head. However, it is also possible for the print head to be moved relative to the platen. Therefore, the term "translating the print head relative to the platen", as used in the appended claims is intended to cover either way of providing the relative movement between the platen and print head.

The invention claimed is:

1. A method of correcting positional errors between an inkjet print head and a stage that supports a substrate, the method comprising:

positioning the print head in a first position such that the inkjet print head is aligned with a first alignment mark formed on the substrate;

moving the print head along a first direction of the substrate from the first position to a second position;

measuring a first deviation between the second position and a second alignment mark formed on the substrate;

moving the print head to the first position such that it is aligned with the first alignment mark;

moving the print head along a second direction of the substrate from the first position to a third position;

measuring a second deviation between the third position and a third alignment mark formed on the substrate; and generating at least one correction factor.

2. A method as claimed in claim 1, further comprising:

calculating a first correction factor for the first deviation; and calculating a second correction factor for the second deviation.

3. A method as claimed in claim 2, further comprising:

determining an offset angle between a first axes on which the first alignment mark and the second alignment mark are located and a second axis on which the first position and the second position are located.

4. A method as claimed in claim 3, further comprising:

applying the at least one correction factor to control at least one of a movement of the stage and a movement of the print head.

5. A method as claimed in claim 1, further comprising:

determining an offset angle between a first axes on which the first alignment mark and the second alignment mark are located and a second axis on which the first position and the second position are located.

6. A method as claimed in claim 5, further comprising:

applying the at least one correction factor to control at least one of a movement of the stage and a movement of the print head.

7. A method as claimed in claim 1, further comprising:

applying the at least one correction factor to control at least one of a movement of the stage and a movement of the print head.

8. A method as claimed in claim 1 wherein the at least one correction factor being used to control the timing of clock pulses for controlling ejection of droplets from the print head.

9. An inkjet deposition apparatus arranged to function in accordance with the method as claimed in claim 1.

10. The method according to clalm 1, the first direction being orthogonal to the second direction.

11. The method according to claim 1, the second alignment mark being located at a first predetermined distance from the first alignment mark along the first direction.

12. The method according to claim 1, further comprising:

calculating at least one correction factor based on at least one of the first deviation and the second deviation.

13. A method of manufacturing a device comprising:

forming a film included in the device, the forming of the film including an ejection of a material toward the substrate that is carried out after the correction of positional errors by the method according to claim 1 is carried out.

14. An inkjet deposition apparatus comprising:

an inkjet print head, a stage for supporting a substrate and providing a relative movement between the inkjet print head and the substrate, and a control unit for controlling the relative positioning of the inkjet print head and the stage, the control unit being arranged to carry out the method of claim 1 to compensate for the positional errors between the stage and the inkjet print head.

15. A method of correcting positional errors between an inkjet print head and a stage that supports a substrate, the method comprising:

positioning the print head in a first position such that the inkjet print head is aligned with one first alignment mark of a plurality of first alignment marks formed on the substrate;

moving the print head along a first direction of the substrate from the first position to a second position;

measuring a first deviation between the second position and one second alignment mark of a plurality of second alignment marks formed on the substrate;

moving the print head to the first position such that it is aligned with the first alignment mark:

moving the print head along a second direction of the substrate from the first position to a third position;

measuring a second deviation between the third position and one third alignment mark of a plurality of third alignment marks formed on the substrate; and generating at least one correction factor.

16. A method as claimed in claim 15, a linear approximation technique being used to generate the at least one correction factor.

17. A method as claimed in claim 15 wherein the at least one correction factor being used to control the timing of clock pulses for controlling ejection of droplets from the print head.

18. A method of correcting positional errors between an inkjet print head and a stage that supports a substrate, the method comprising:

positioning the print head at each first position of a plurality of first positions such that the inkjet print head is aligned with one first alignment mark of a plurality of first alignment marks formed on the substrate;

moving the print head along a first direction of the substrate from each first position to one second position of a plurality of second positions;

measuring a first deviation between one second position and one second alignment mark of a plurality of second alignment marks formed on the substrate;

moving the print head to the first position such that it is aligned with the first alignment mark;

moving the print head along a second direction of the substrate from one first position to one third position of a plurality of third positions;

measuring a second deviation between one third position and one third alignment mark of a plurality of third alignment marks formed on the substrate; and calculating a correction factor based on the first deviation and the second deviation, the positioning of the print head, the moving of the print head along the first direction, the measuring of the first deviation, the moving of the print head along the second direction, the measuring of the second deviation and the calculating of the correction factor being repeated for each of the plurality of first positions.

19. A method as claimed in claim 18, the alignment marks being positioned on the substrate using a polynomial or spline curve relationship, and a polynomial or spline curve approximation technique being used to generate a correction factor for at least one set of alignment marks comprising a first position, a second position and a third position.

20. A method as claimed in claim 18 wherein the at least one correction factor being used to control the timing of clock pulses for controlling ejection of droplets from the print head.

* * * * *